US009435047B2

(12) United States Patent
Dingwerth et al.

(10) Patent No.: US 9,435,047 B2
(45) Date of Patent: Sep. 6, 2016

(54) PROCESS FOR CORROSION PROTECTION OF IRON CONTAINING MATERIALS

(71) Applicant: Atotech Deutschland GmbH, Berlin (DE)

(72) Inventors: Björn Dingwerth, Langenfeld (DE); Mike Krüger, Griesheim (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/647,458

(22) PCT Filed: Jan. 7, 2014

(86) PCT No.: PCT/EP2014/050159

§ 371 (c)(1),
(2) Date: May 27, 2015

(87) PCT Pub. No.: WO2014/154366

PCT Pub. Date: Oct. 2, 2014

(65) Prior Publication Data

US 2016/0002804 A1 Jan. 7, 2016

(30) Foreign Application Priority Data

Mar. 26, 2013 (EP) ..... 13161011

(51) Int. Cl.

| | |
|---|---|
| ***C23C 28/00*** | (2006.01) |
| ***C25D 5/10*** | (2006.01) |
| ***C25D 3/56*** | (2006.01) |
| ***C25D 5/48*** | (2006.01) |
| ***C23C 22/83*** | (2006.01) |
| *C25D 5/14* | (2006.01) |

(52) U.S. Cl.

CPC ..... *C25D 5/10* (2013.01); *C23C 22/83* (2013.01); *C25D 3/565* (2013.01); *C25D 5/48* (2013.01); *C23C 2222/10* (2013.01); *C25D 5/14* (2013.01)

(58) Field of Classification Search

CPC ..... C23C 28/00; C23C 28/34; C23C 28/345; C23C 28/347; C23C 28/36

USPC ..... 205/191, 194, 195, 197, 176

See application file for complete search history.

(56) References Cited

U.S. PATENT DOCUMENTS

| | | | | |
|---|---|---|---|---|
| 4,849,301 | A | 7/1989 | Kanasashi | |
| 6,071,631 | A * | 6/2000 | Takahata | C25D 5/10 428/632 |
| 2005/0236060 | A1 | 10/2005 | Matsubara | |
| 2008/0110762 | A1 * | 5/2008 | Gollan | C25D 3/565 205/246 |
| 2010/0133113 | A1 * | 6/2010 | Krizova | C23C 22/48 205/724 |

FOREIGN PATENT DOCUMENTS

| | | | |
|---|---|---|---|
| DE | 102010026046 | 1/2012 | |
| JP | 63093887 A * | 4/1988 | C25D 5/26 |

OTHER PUBLICATIONS

Ashlund, "Release Rates and Environmental Impact of Zinc-Nickel Coatings in the Automotive Industry," Master of Science Thesis, Stockholm, Sweden (no month, 2006), pp. 1-84.*

Ross, "Electrodeposited Multilayer Thin Films," Annu. Rev. Mater. Sci. (no month, 1994), vol. 24, pp. 159-188.*

PCT/EP2014/050159; PCT International Search Report and Written Opinion of the International Searching Authority dated Feb. 6, 2014.

* cited by examiner

*Primary Examiner* — Edna Wong

(74) *Attorney, Agent, or Firm* — Renner, Otto, Boisselle & Sklar, LLP

(57) ABSTRACT

The present invention relates to a process for corrosion protection of an iron-containing substrate wherein a first zinc-nickel alloy layer, a second zinc-nickel alloy layer and a black passivate layer are deposited onto the substrate. The nickel concentration in the second zinc-nickel alloy layer is higher than the nickel concentration in the first zinc-nickel alloy layer. The substrate surface obtained is homogenously black with an appealing decorative appearance and both resistance against white rust and red rust are improved.

11 Claims, No Drawings

PROCESS FOR CORROSION PROTECTION OF IRON CONTAINING MATERIALS

The present application is a U.S. National Stage Application based on and claiming benefit and priority under 35 U.S.C. §371 of International Application No. PCT/EP2014/050159, filed 7 Jan. 2014, which in turn claims benefit of and priority to European Application No. 13161011.5 filed 26 Mar. 2013, the entirety of both of which is hereby incorporated herein by reference.

FIELD OF THE INVENTION

The present invention relates to a process for obtaining a black zinc-nickel surface on a substrate made of an iron-containing material which provides corrosion protection to the substrate.

BACKGROUND OF THE INVENTION

The application of conversion coating solutions to render a surface black is a common technique being widely applied to zinc and zinc alloy layers including zinc-cobalt, zinc-nickel and zinc-iron layers. Zinc and zinc alloy layers may be applied by hot dip galvanizing but are most commonly applied by electroplating from plating solutions.

Conversion coatings applied to a zinc or zinc alloy layer rendering a surface black are common to the field and comprise a basic chromium(III) complex and an oxidation agent in an acidic solution.

These formulations, also referred to as passivates form a chromium(III) based passivation layer with black pigment particles generated in situ. The chromium(III)-complex based layers increase corrosion protection already provided by the zinc or zinc alloy layer and the black pigments in the passivation layer render the surface of the coated substrate black. The additional corrosion protection provided by the chromium(III)-passivate layer is caused by a barrier function delaying the access of any corrosive solution to the zinc or zinc alloy layer.

Unfortunately, black pigmented passivate layers do not bear the same corrosion protection like it is found in non pigmented, so called clear or iridescent passivate layers. The black pigments do not contribute to corrosion protection and to some extend may interfere with the barrier functionality.

This results in a more permeable structure of the black passivate layer in turn leading to earlier formation of undesired white corrosion on the surface (white rust). Those white corrosion products on the surface form a thin, dense layer improving the barrier function of the passivate layer and thereby resulting in a self inhibition of the corrosion which usually stops on the level of a thin, haze like white cover with corrosion products. The optical appearance of such a black surface is not sufficient anymore after formation of white rust.

This effect can particularly be observed on the surface of black passivated zinc-nickel alloy layers which usually have a nickel concentration of 12 to 15 wt.-%. The nickel concentration range is chosen in order to obtain the best cathodic corrosion resistance to substrates made of iron-containing materials at a sufficiently slow corrosion rate to reach 720 h to iron corrosion (formation of red rust) at 8 μm thickness of the zinc-nickel alloy layer as determined in the neutral salt spray test according to ISO 9227 NSS. However, white rust formed already at an early stage alters the optical appearance of the black surface in an undesired manner by formation of e.g. white haze.

A higher nickel concentration in the zinc-nickel alloy layer inevitably leads to premature red corrosion due to localized galvanic corrosion with no or very low cathodic protection potential. Typically, such substrates covered with a zinc-nickel alloy layer of >16 wt.-% nickel undergo very early punctual red corrosion rendering such a high nickel concentration in a zinc-nickel alloy layer useless.

OBJECTIVE OF THE PRESENT INVENTION

The objective of the present invention is to provide a process for corrosion protection based on zinc-nickel alloy layers which provides a higher corrosion resistance to substrates made of iron-containing materials and at the same time provides and maintains a homogeneous and desirable black appearance.

SUMMARY OF THE INVENTION

The process for corrosion protection of an iron-containing substrate according to the present invention comprises, in this order, the steps of (i) providing a substrate made of an iron-containing material, (ii) electroplating onto said substrate a first zinc-nickel alloy layer having a nickel concentration in the range of 6 to 15 wt.-%, (iii) thereon, electroplating a second zinc-nickel alloy layer having a nickel concentration in the range of 12 to 30 wt.-% onto the first zinc-nickel alloy layer with the proviso that the concentration of nickel in the second zinc-nickel alloy layer is higher than the nickel concentration in the first zinc-nickel alloy layer, and (iv) depositing a black passivation layer onto the second zinc-nickel alloy layer.

The substrate obtained by the process according to the present invention has a homogeneous, uniform black surface and an increased resistance to corrosion.

DETAILED DESCRIPTION OF THE INVENTION

The present invention is directed to the corrosion protection of substrates having a black appearance. Typical substrates are for example brake calipers and fasteners. The substrate is made of a metallic material, preferably an iron-containing alloy such as cast iron (iron and ferrous alloys preferably comprising carbon and/or silicon as main alloying elements).

The substrate is cleaned prior to any plating procedures with standard methods known in the art. For example, cleaners comprising a tenside, acidic cleaners and the like as well as application of ultrasonic radiation or electrical current during cleaning can be adapted to the substrate to be plated by the process according to the present invention.

Acidic aqueous zinc-nickel electrolytes for depositing a first zinc-nickel alloy layer and a second zinc-nickel alloy layer suitable for the process according to the present invention comprise zinc ions in a concentration preferably ranging from 0.1 to 100 g/l, more preferably from 5 to 60 g/l and most preferably from 20 to 35 g/l. Suitable sources for zinc ions are for example zinc oxide, zinc chloride, zinc sulfate, zinc fluoroborate, zinc acetate and mixtures thereof.

The zinc-nickel electrolytes of the present invention further comprise nickel ions with concentrations preferably ranging from 0.1 to 60 g/l, more preferably from 10 to 50 g/l and most preferably from 25 to 35 g/l. Sources of nickel ions comprise nickel hydroxide, inorganic salts of nickel, and organic salts of nickel. In one embodiment, the nickel source includes one or more of nickel hydroxide, nickel sulfate, nickel carbonate, ammonium nickel sulfate, nickel sulfamate, nickel acetate, nickel formate, nickel bromide, nickel chloride.

In one embodiment, the zinc ion and the nickel ion are present at concentrations sufficient to deposit a zinc-nickel alloy comprising a nickel content from 6 to 30 wt % of the zinc-nickel alloy layer.

The concentration of nickel in the first zinc-nickel alloy layer preferably ranges from 6 to 15 wt.-%, more preferably from 10 to 15 wt.-% and most preferably from 12 to 15 wt.-%. The concentration of nickel in the second zinc-nickel alloy layer preferably ranges from 12 to 30 wt.-%, more preferably from 13 to 20 wt.-% and most preferably from 15 to 18 wt.-%. The concentration of nickel in the first and second zinc-nickel alloy layer are chosen from said concentration ranges with the provision that the concentration of nickel in the second zinc-nickel alloy layer is higher than the nickel concentration in the first zinc-nickel alloy layer.

The concentration represented in weight-% of nickel in the first zinc-nickel alloy layer is preferably 50 to 99%, more preferably 60 to 95% and most preferably 70 to 90% of the concentration represented in weight-% of nickel in the second zinc-nickel alloy layer.

Theses ranges are further explained with the following example: the nickel concentration in the first zinc-nickel alloy layer deposited in Example 3 is 13 wt.-% and the nickel concentration in the second zinc-nickel alloy layer in the same example is 16.5 wt.-%. Hence, the nickel concentration in the first zinc-nickel alloy layer represented in weight-% was 79% of the nickel concentration of the second zinc-nickel alloy layer.

The zinc-nickel electrolytes of the invention further contain an acidic component in sufficient quantity to provide the bath with an acidic pH. The acidic electroplating bath preferably has a pH value in the range from 0.5 to 6.5, more preferably from 1 to 6, and most preferably from 1 to 5.

The zinc-nickel electrolytes include any appropriate acid, organic or inorganic or appropriate salt thereof. In one embodiment, the zinc-nickel electrolytes comprise one or more of hydrochloric acid, sulfuric acid, sulfurous acid, phosphorous acid, hypophosphorous acid, an aromatic sulfonic acid such as substituted or unsubstituted benzene sulfonic acids, toluene sulfonic acids, and similar and related aromatic sulfonic acids, methane sulfonic acids and similar alkyl sulfonic acids, a poly carboxylic acid such as citric acid, sulfamic acid, fluoroboric acid or any other acid capable of providing a suitable acidic pH. The acid itself or an appropriate salt thereof may be used, as needed, e.g., to obtain the desired pH and ionic strength.

The zinc-nickel electrolytes of the invention further comprise one or more complexing agent. The use of complexing agents and other organic additives is well known in the art and suitable complexing agents are for example described in document US 2005/0189231 A1.

Preferably, the aqueous acidic zinc-nickel electrolyte for depositing the first zinc-nickel alloy layer and the second aqueous acidic zinc-nickel electrolyte for depositing the second zinc-nickel alloy layer are both free of ammonia and salts thereof.

In one embodiment of the present invention, the first zinc-nickel alloy layer is deposited from a first acidic zinc-nickel electrolyte and the second zinc-nickel alloy layer is deposited from a second acidic zinc-nickel electrolyte which is different from the first acidic zinc-nickel electrolyte.

In another preferred embodiment of the present invention, the same (acidic) zinc-nickel electrolyte composition in terms of concentration of the main components such as zinc ions and nickel ions is used for deposition of the first zinc-nickel alloy layer in a first tank and deposition of the second zinc-nickel alloy layer in a second tank. The higher nickel concentration in the second zinc-nickel alloy layer is obtained by modifying the pH value of the zinc-nickel electrolyte in respect to the zinc-nickel electrolyte used for depositing the first zinc-nickel alloy layer and/or by adjusting the temperature of the zinc-nickel electrolyte accordingly, following the observation that acidic, chloride based zinc-nickel alloy electrolytes deposit a higher Ni concentration in the zinc-nickel alloy layer with increased temperature and/or decreased pH. No rinsing of the substrate with e.g. water between steps (ii) and (iii) is necessary in this preferred embodiment. Hence, the amount of waste water can be reduced.

In the process according to the present invention, the deposition of the first zinc-nickel alloy layer and the second zinc-nickel alloy layer is preferably carried out at a current density in the range from 0.01 to 150 $A/dm^2$, more preferably from 0.5 to 25 $A/dm^2$ and most preferably from 1 to 10 $A/dm^2$. Steps (ii) and (iii) of the process according to the present invention may be carried out at room temperature, or at a lower or higher temperature. In one embodiment, the plating process steps may preferably be carried out at a temperature in the range from 10 to 90° C., more preferably from 15 to 45° C., and most preferably from 25 to 40° C.

The overall (combined) thickness of both zinc-nickel alloy layers preferably ranges from 4 to 30 μm, more preferably from 5 to 20 μm and most preferably from 6 to 15 μm. The thickness ratio (thickness of the first zinc-nickel alloy layer:thickness of the second zinc-nickel alloy layer) preferably ranges from 1:1 to 9:1.

Preferably, the substrate is rinsed with e.g. water after depositing the second zinc-nickel alloy layer.

Next, a black passivate layer is deposited onto the second zinc-nickel alloy layer. The black passivate layer is preferably deposited from an aqueous treatment solution comprising chromium(III) ions, a complexing agent and an oxidizing agent. Such treatment solutions are preferably acidic and more preferably have a pH value in the range of 1 to 4.

Suitable sources for chromium(III) ions are water soluble salts of chromium(III). The concentration of chromium(III) ions in the solution preferably ranges from 20 to 400 mmol/l.

Suitable complexing agents are for example carboxylic acids and/or salts thereof, and fluoride ions. Also mixtures of two different carboxylic acids or salts thereof can be utilized as complexing agents. Also carboxylic acids or salts thereof comprising a further polar group such as an —OH, —$SO_3H$, —NH group can be used as complexing agents.

The at least one oxidizing agent is preferably selected from nitrate ions, aromatic nitro compounds, pyridine N-oxides, morpholine N-oxides and p-benzoquinone. Most preferably, the oxidizing agent are nitrate ions.

A preferred treatment solution for depositing a black passivate layer onto the second zinc-nickel alloy layer is disclosed in US 2010/0133113 A1.

The temperature of the treatment solution is preferably held in a temperature range of 20 to 60° C., more preferably 20 to 40° C. and most preferably 20 to 30° C. during deposition of the black passivate layer. The substrate is preferably contacted with the treatment solution for 10 to 180 s, more preferably for 30 to 90 s and most preferably for 45 to 90 s.

In one embodiment of the present invention the substrate having a first zinc-nickel alloy layer, a second zinc-nickel alloy layer and a black passivate layer attached thereon is further treated with one or more treatment solutions in order to deposit at least one further layer selected from sealing layer and non pigmented chromium(III) containing passivation layer onto the black passivate layer obtained in step (iv). Non pigmented chromium(III) containing passivation layers have either a clear or iridescent optical appearance.

For example, a sealer layer is directly deposited onto the black passivate layer obtained in step (iv), or a non pigmented chromium(III) containing passivation layer is deposited onto the black passivate layer obtained in step (iv), or a non pigmented chromium(III) containing passivation layer is deposited onto the black passivate layer obtained in step (iv) and then a sealing layer is deposited onto the non pigmented chromium(III) containing passivation layer.

The non pigmented chromium(III) containing passivation layer is preferably deposited onto the black passivate layer obtained in step (iv) from a treatment solution comprising chromium(III) ions and a phosphorous containing compound such as phosphoric acid or a salt thereof, an organic phosphate, an organic phosphonate or mixtures of the aforementioned substances. Such treatment solutions are usually free of a strong oxidizing agent (such as nitrate ions) which is a mandatory ingredient of treatment solutions for depositing a black passivate layer in step (iv) of the process according to the present invention.

The colour of the underlying black passivate layer obtained in step (iv) is maintained when depositing a non pigmented chromium(III) containing passivation layer thereon.

A preferred treatment composition for depositing a non pigmented chromium(III) containing passivation layer onto the black passivate layer obtained in step (iv) is disclosed in US 2010/0180793 A1.

The optional sealing layer is preferably an inorganic sealing layer. Such a sealing layer can be deposited from solutions comprising film forming ingredients such as organo-silanes (tri- and tetra-alkoxides of silicon), other metal/transition metal alkoxides, inorganic silicates, and silica. Such solutions and their use are known in the art.

A preferred solution for depositing an optional sealing layer is disclosed in U.S. Pat. No. 6,478,886 B1.

The process according to the present invention provides corrosion protection to iron containing substrate materials, particularly to substrates made of cast iron which maintains a homogeneous and uniform black colour and an appealing decorative appearance after successive application of a black passivate layer and is sufficient both in terms of white rust and red rust formation according to ISO 9227 NSS. Such desired properties can not be obtained when using a single zinc-nickel alloy layer in combination with a black passivate layer attached thereon (Examples 1 and 2).

A first zinc-nickel alloy layer having a lower nickel concentration is required in direct contact with the iron-containing substrate material in order to achieve a sufficient stability against red rust formation and a second zinc-nickel alloy layer having a higher nickel concentration is required on top of the first zinc-nickel alloy layer in order to achieve a sufficient stability against white rust formation.

EXAMPLES

The invention is further illustrated by the following non-limiting examples.

General Procedure:

A brake component made from spheroidal graphite containing cast iron was used throughout all examples as substrate material. The substrate was cleaned prior to electroplating with standard methods.

Zinc-nickel alloy layers were deposited from an acidic aqueous zinc-nickel electrolyte (Zinni® AC AF 210, a product of Atotech Deutschland GmbH).

The substrates were rinsed with water prior to depositing a black passivate layer onto the zinc-nickel alloy layer (onto the second zinc-nickel alloy layer in case of Example 3) from a black passivate solution comprising chromium(III) ions and having a pH value of 1.7 (Unifix® Ni 3-34 L, a product of Atotech Deutschland GmbH) at 25° C. with an immersion time of 60 s. The substrates were rinsed again and then dipped into a non pigmented chromium(III) based post-dip solution having a pH value of 5 (Tridur® Finish 300, a product of Atotech Deutschland GmbH) at 50° C. with an immersion time of 60 s.

After drying in a hot air drier for 2 min at 80° C., the substrates were dipped into an inorganic silicate based sealer solution (Sealer 400 W, a product of Atotech Deutschland GmbH) at 80° C. for 60 min and then dried for 15 min at 80° C. in a hot air drier.

A neutral salt spray test according to ISO 9227 NSS was applied to substrates obtained in all Examples and the time to formation of white rust and red rust was determined.

Example 1

Comparative

A single zinc-nickel alloy layer with a nickel concentration of 13 wt.-% and an average thickness of 8 μm was deposited onto the substrate by running the above mentioned electrolyte at pH 5.2 and 35° C.

The substrate surface is homogenously black with an appealing decorative appearance after successive application of the black passivate layer, the non pigmented chromium(III) containing layer and the sealing layer.

After 24 h significant amounts of white corrosion products can be observed on all surface areas. Red rust was observed after 720 h.

Example 2

Comparative

A single zinc-nickel alloy layer with a nickel concentration of 16.5 wt.-% and an average thickness of 8 μm was deposited onto the substrate by running the above mentioned electrolyte at pH 4.5 and 42° C.

The substrate surface is homogenously black with an appealing decorative appearance after successive application of the black passivate layer, the non pigmented chromium(III) containing layer and the sealing layer.

After 120 h still no white corrosion products become visible on the exposed relevant surface areas. Undesired spots of red rust were observed after 480 h.

Example 3

Invention

A first zinc-nickel alloy layer with a nickel alloy concentration of 13 wt.-% was deposited onto the substrate by running the above mentioned electrolyte at pH 5.2 and 35°

C. Next, without intermediate rinsing, a second zinc-nickel alloy layer with a nickel alloy concentration of 16.5 wt.-% was deposited onto the first zinc-nickel alloy layer by running the above mentioned electrolyte at pH 4.5 and 42° C. The overall thickness of both zinc-nickel alloy layers was 8 μm.

The substrate surface is homogenously black with an appealing decorative appearance after successive application of the black passivate layer, the non pigmented chromium(III) containing layer and the sealing layer.

After 120 h still no white corrosion products become visible on the exposed relevant surface areas. Red rust was not observed until 720 h.

The invention claimed is:

1. A process for corrosion protection of an iron-containing substrate comprising, in this order, the steps of (i) providing a substrate made of an iron-containing material, (ii) electroplating onto said substrate a first zinc-nickel alloy layer having a nickel concentration in the range of 6 to 15 wt.-%, (iii) thereon, electroplating a second zinc-nickel alloy layer having a nickel concentration in the range of 12 to 30 wt.-% onto the first zinc-nickel alloy layer with the proviso that the concentration of nickel in the second zinc-nickel alloy layer is higher than the nickel concentration in the first zinc-nickel alloy layer, and (iv) depositing a black passivation layer onto the second zinc-nickel alloy layer, wherein an acidic zinc-nickel electrolyte used for electroplating the first zinc-nickel alloy layer and an acidic zinc-nickel electrolyte used for electroplating the second zinc-nickel alloy layer are the same acidic zinc-nickel electrolyte and wherein the nickel concentrations in both zinc-nickel alloy layers are adjusted by changing pH value, temperature, or both the pH value and the temperature of one or both of the acidic zinc-nickel electrolyte used for electroplating the first zinc-nickel alloy layer and the acidic zinc-nickel electrolyte used for electroplating the second zinc-nickel alloy layer during the electroplating steps.

2. The process for corrosion protection of a substrate according to claim 1 wherein the substrate is made of cast iron.

3. The process for corrosion protection of a substrate according to claim 1 wherein the concentration of nickel in the first zinc-nickel alloy layer ranges from 10 to 15 wt.-%.

4. The process for corrosion protection of a substrate according to claim 1 wherein the concentration of nickel in the first zinc-nickel alloy layer ranges from 12 to 15 wt.-%.

5. The process for corrosion protection of a substrate according to claim 1 wherein the concentration of nickel in the second zinc-nickel alloy layer ranges from 13 to 20 wt.-%.

6. The process for corrosion protection of a substrate according to claim 1 wherein the concentration of nickel in the second zinc-nickel alloy layer ranges from 15 to 18 wt.-%.

7. The process for corrosion protection of a substrate according to claim 1 wherein the concentration represented in weight-% of nickel in the first zinc-nickel alloy layer is 50 to 99% of the concentration represented in weight-% of nickel in the second zinc-nickel alloy layer.

8. The process for corrosion protection of a substrate according to claim 1 wherein the concentration represented in weight-% of nickel in the first zinc-nickel alloy layer is 60 to 95% of the concentration represented in weight-% of nickel in the second zinc-nickel alloy layer.

9. The process for corrosion protection of a substrate according to claim 1 wherein the concentration represented in weight-% of nickel in the first zinc-nickel alloy layer is 70 to 90% of the concentration represented in weight-% of nickel in the second zinc-nickel alloy layer.

10. The process for corrosion protection of a substrate according to claim 1 wherein the black passivation layer is deposited from an acidic aqueous solution comprising chromium(III) ions, a complexing agent and an oxidizing agent.

11. The process for corrosion protection of a substrate according to claim 1 wherein at least one further layer selected from sealing layer and non pigmented chromium (III) containing passivation layer is deposited onto the black passivate layer obtained in step (iv).

* * * * *